US009193150B2

(12) United States Patent
Noguchi et al.

(10) Patent No.: US 9,193,150 B2
(45) Date of Patent: Nov. 24, 2015

(54) IMAGE RECORDING METHOD

(71) Applicant: CANON KABUSHIKI KAISHA, Tokyo (JP)

(72) Inventors: Mitsutoshi Noguchi, Kawaguchi (JP); Ryota Takeuchi, Yokohama (JP); Midori Kushida, Tokyo (JP); Yoshikazu Saito, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/681,937

(22) Filed: Apr. 8, 2015

(65) Prior Publication Data

US 2015/0290928 A1 Oct. 15, 2015

(30) Foreign Application Priority Data

Apr. 14, 2014 (JP) ..... 2014-082682

(51) Int. Cl.
*B41J 2/005* (2006.01)
*B41J 2/01* (2006.01)

(52) U.S. Cl.
CPC ..... *B41J 2/0057* (2013.01); *B41J 2/005* (2013.01); *B41J 2002/012* (2013.01)

(58) Field of Classification Search
USPC ..... 347/1, 101, 103
See application file for complete search history.

(56) References Cited

U.S. PATENT DOCUMENTS 5,623,296 A * 4/1997 Fujino et al. ..... 347/103
8,152,292 B2 * 4/2012 Ikuno et al. ..... 347/103
2014/0247302 A1 * 9/2014 Ohnishi et al. ..... 347/21
2014/0368563 A1 * 12/2014 Noguchi ..... 347/1

FOREIGN PATENT DOCUMENTS

JP 3177985 B2 6/2001
JP 2009-45851 A 3/2009

* cited by examiner

*Primary Examiner* — Huan Tran
(74) *Attorney, Agent, or Firm* — Canon U.S.A., Inc., IP Division

(57) ABSTRACT

An image recording method includes applying a reaction liquid containing a first polymer particle onto an intermediate transfer member, forming an intermediate image by applying an ink containing a second polymer particle onto the intermediate transfer member to which the reaction liquid has been applied, and transferring the intermediate image to a recording medium while heating the intermediate image. The first polymer particle softens at temperature T1 and the second polymer particle softens at temperature T2. The transferring is performed so that the surface temperature Ta of the recording medium and the surface temperature Tb of the intermediate transfer member satisfy: (1) Tb<Ta, (2) T2<Ta, and (3) Tb<T1, and so that the elastic modulus Ea of the intermediate image at the temperature Ta and the elastic modulus Eb of the intermediate image at the temperature Tb satisfy 1.5<Eb/Ea.

8 Claims, 1 Drawing Sheet

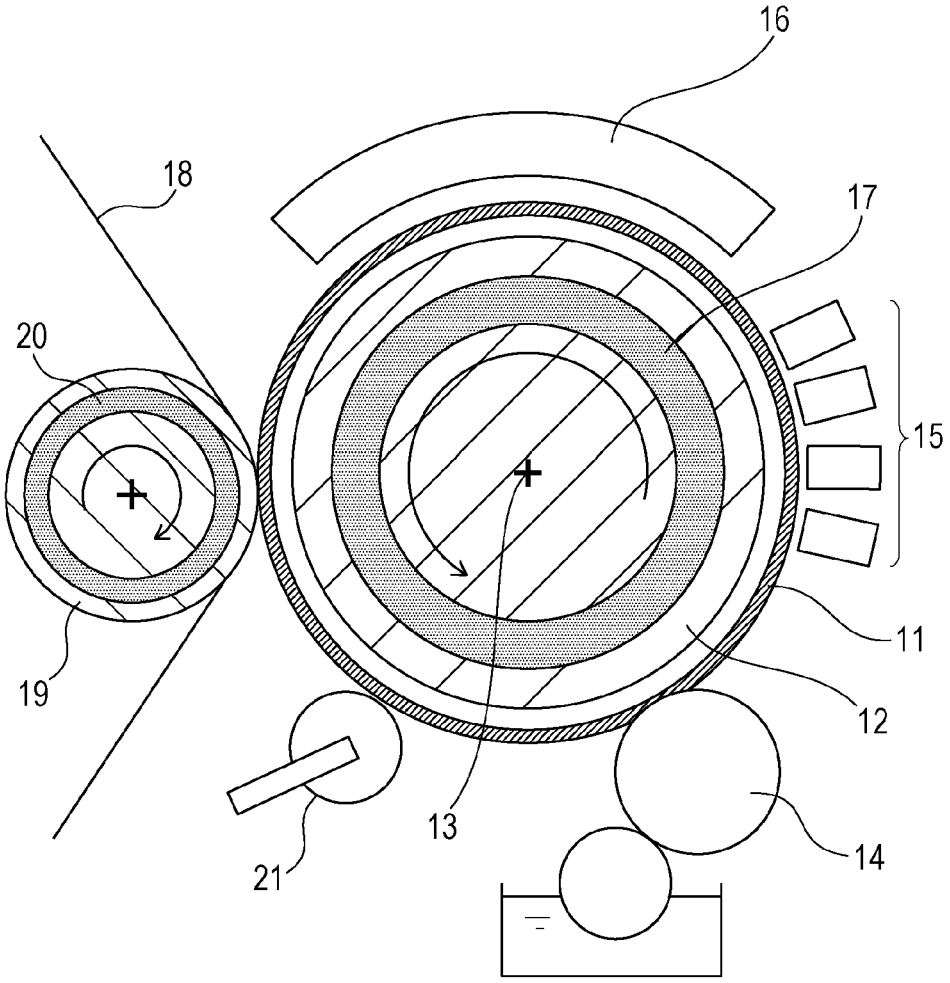
16
18
17
20
15
11
19
12
13
14
21

IMAGE RECORDING METHOD

BACKGROUND OF THE INVENTION

1. Field of the Invention

The present invention relates to an image recording method.

2. Description of the Related Art

As the variety of information is increasing, more different printed articles are produced in smaller lots. This increases the cost of printing plate making for each printed article and results in comparatively high cost in known printing methods such as offset printing. In addition, immediacy of information has increasingly become important. A printing method requiring a long lead time for preparation for printing including printing plate making cannot respond to the trend of reducing delivery period of time even if the number of prints are small. An ink jet printing method is expected to be a suitable technique for responding to such market demands. More specifically, since the ink jet printing method does not use a printing plate, the cost of plate making does not increase even for a small lot. Also, the ink jet printing method enables desired printed articles to be immediately produced without requiring lead time, thus being considered to be suitable for printing a variety of different articles in small lots.

Unfortunately, the ink jet printing method can produce images with degraded quality in terms of specific properties.

One of the phenomena that cause such image quality degradation is bleeding that occurs when ink is directly applied onto a recording medium having a highly smooth surface. Such a recording medium cannot sufficiently absorb the ink and allows the ink to remain on the surface of the recording medium and mix with adjacently applied droplets. Bleeding thus occurs.

Another one of the phenomena is beading that is a phenomenon in which previously applied droplets are attracted to subsequently applied droplets.

A third one of the phenomena is curling and cockling caused by excessive absorption of the liquid component from the ink into the recording medium.

In order to reduce image quality degradation resulting from these phenomena, an image recording method using a transfer technique (hereinafter referred to as transfer image recording method) has been devised. The transfer image recording method includes the steps of applying a reaction liquid, forming an intermediate image, and transferring the intermediate image. In the step of applying a reaction liquid, a reaction liquid is applied onto an intermediate transfer member. The reaction liquid will come into contact with the coloring material in an ink, thereby forming a viscous intermediate image. In the subsequent step of forming an intermediate image, an intermediate image is formed by applying an ink containing a coloring material onto the intermediate transfer member to which the reaction liquid has been applied. In the step of transferring, the intermediate image is transferred to a recording medium by pressing the intermediate transfer member having the intermediate image on the recording medium.

In the transfer image recording method, in some cases, part of intermediate image cannot be transferred from the intermediate transfer member to the recording medium, remaining on the intermediate transfer member, and results in a defect in the final image. Accordingly, there have been devised transfer image recording methods in which the performance of transfer has been improved.

Japanese Patent No. 3177985 discloses a method using an ink containing a thermoplastic resin. In the method, the intermediate image is heated to a temperature more than or equal to the softening temperature or melting temperature of the thermoplastic resin, and then the intermediate image is transferred to the recording medium.

Also, Japanese Patent Laid-Open No. 2009-45851 discloses a method in which a treatment liquid containing particles is applied onto the intermediate transfer member.

SUMMARY OF THE INVENTION

An image recording method of an embodiment includes the steps of applying a reaction liquid containing a first polymer particle onto an intermediate transfer member, forming an intermediate image by applying an ink containing a second polymer particle onto the intermediate transfer member to which the reaction liquid has been applied, and transferring the intermediate image to a recording medium while heating the intermediate image. The first polymer particle softens at temperature T1, and the second polymer particle softens at temperature T2. The step of transferring is performed so that the surface temperature Ta of the recording medium and the surface temperature Tb of the intermediate transfer medium satisfy the relationships: (1) Tb<Ta, (2) T2<Ta, and (3) Tb<T1. In this step, the elastic modulus Ea of the intermediate image at the temperature Ta and the elastic modulus Eb of the intermediate image at the temperature Tb satisfy the relationship 1.5<Eb/Ea.

Further features of the present application will become apparent from the following description of exemplary embodiments with reference to the attached drawing.

BRIEF DESCRIPTION OF THE DRAWINGS

The FIGURE is a schematic view of an image recording apparatus using an image recording method according to an embodiment.

DESCRIPTION OF THE EMBODIMENTS

For applying a transfer image recording method to printing of a variety of articles in small lots, the transfer image recording method needs to be able to perform high-speed printing like a known offset printing method. Accordingly, it is desired to achieve high performance of transfer from the intermediate transfer member to the recording medium even in high-speed printing. In order to increase the efficiency of transfer from the intermediate transfer member to the recording medium, the adhesion F1 between the intermediate transfer member and the intermediate image and the adhesion F2 between the recording medium and the intermediate image satisfy F1<F2. It is generally considered that on coming into contact between the intermediate image and the recording medium, adhesion between the intermediate image and the recording medium starts to increase as the intermediate image spreads on the recording medium to increase the contact area therebetween. Accordingly, it is assumed that the adhesion F2 between the recording medium and the intermediate image increases for the period of nipping (hereinafter referred to as nip time), from the moment when the recording medium comes into contact with the intermediate transfer member to the moment when it leaves the intermediate transfer member. When the intermediate image is transferred to the recording medium at a high speed, however, the period of contact between the intermediate transfer member and the recording medium, that is, the nip time, is very short. It is therefore desired to efficiently increase the adhesion F2 between the recording medium and the intermediate image so as to create a condition of F1<F2 in a short time.

According to a study of the present inventors on the method disclosed in the above-cited Japanese Patent No. 3177985, when an intermediate image was transferred from an intermediate transfer member to a recording medium, transfer efficiency was insufficient in some cases. The reason can be the following. The fluidity of the ink is considerably increased by heating the thermoplastic resin in the ink to a temperature more than or equal to the temperature at which the thermoplastic resin softens. As a result, the adhesion F1 between the intermediate transfer member and the intermediate image increases while the adhesion F2 between the recording medium and the intermediate image increases. This is the reason why the relationship F1<F2 was not established within a short nip time. In order to increase the transfer efficiency in high speed printing, only the adhesion F2 between the recording medium and the intermediate image must efficiently be increased within the nip time.

According to another study of the present inventors, the method disclosed in the above-cited Japanese Patent Laid-Open No. 2009-45851 did not exhibit satisfactory transfer efficiency in some cases. This is probably because the fluidity of the treatment liquid increased easily because of the low glass transition temperature of the particles in the treatment liquid and, accordingly, the adhesion F1 between the intermediate transfer member and the intermediate image increased.

The present invention has been accomplished in view of the above issues. The present application provides an image recording method in which the efficiency of transfer from the intermediate transfer member to the recording medium in high-speed printing has been improved.

In the image recording method according to an embodiment, a reaction liquid containing a first polymer particle is applied onto an intermediate transfer member, and then an intermediate image is formed by applying an ink containing a second polymer particle onto the intermediate transfer member to which the reaction liquid has been applied. Subsequently, the intermediate image is transferred to a recording medium while being heated (transferring step). In this transferring step, the surface temperature Ta of the recording medium and the surface temperature Tb of the intermediate transfer member are controlled so as to satisfy the relationships: (1) Tb<Ta, (2) T2<Ta, and (3) Tb<T1, wherein T1 is the temperature at which the first polymer particle softens, and T2 is the temperature at which the second polymer particle softens. Also, in the transferring step, the surface temperatures Ta and Tb are such that the elastic moduli of the intermediate image satisfy the relationship 1.5<Eb/Ea, wherein Ea is the elastic modulus of the intermediate image at a temperature equal to Ta, and Eb is the elastic modulus of the intermediate image at a temperature equal to Tb. Thus the efficiency of transfer from the intermediate transfer member to the recording medium in high speed printing can be increased. The reason of this will be described below.

In order to increase the efficiency of transfer from the intermediate transfer member to the recording medium, the adhesion F1 between the intermediate transfer member and the intermediate image and the adhesion F2 between the recording medium and the intermediate image must be F1<F2 as described above. Also, since the nip time for high speed printing is very short, it is desired to efficiently increase the adhesion F2 between the recording medium and the intermediate image to create a condition of F1<F2 in a short time. In this instance, it is important to suppress the increase of adhesion F1. In high speed printing described herein, the nip time is in the range of 1 ms to 100 ms. The nip width can arbitrarily be set. The printing speed, that is, the conveyance speed of a recording medium, depends on the nip time and the nip width.

The intermediate image on the intermediate transfer member has a first surface in contact with the intermediate transfer member and a second surface that is exposed before being transferred and will come into contact with a recording medium when being transferred. The first and the second surface oppose each other. The present inventors have found that, in order to efficiently increase adhesion F2 and establish the condition of F1<F2 at a short time, it is important to control the fluidity of the intermediate image so as to increase in the first surface side and to decrease in the second surface side. Then, the present inventors have found that the fluidity of the intermediate image can be increased in the second surface side and reduced in the first surface side by heating the intermediate image under the conditions satisfying the above relationships.

More specifically, the intermediate image is heated under the conditions satisfying the above relationship (1) Tb<Ta. Still more specifically, the intermediate image is heated so as to have such a temperature gradient that the temperature thereof decreases in the direction from the second surface to the first surface. Consequently, the portion of the intermediate image near the second surface has a higher temperature than the portion of the intermediate image near the first surface, accordingly having a lower viscosity. Thus, the fluidity of the intermediate image can be increased in the second surface side and reduced in the first surface side.

The intermediate image is also heated under the conditions satisfying the above relationships (2) T2<Ta and (3) Tb<T1. In the present embodiment, after the reaction liquid containing a first polymer particle is applied onto the intermediate transfer member, an ink containing a second polymer particle is applied onto the intermediate transfer member. On applying the ink onto the reaction liquid previously applied to the intermediate transfer member, a reaction that increases the viscosity of the ink starts at the contact between the reaction liquid and the ink. The reaction liquid and the ink are thus brought into a state where they are not easily mixed with each other. Consequently, it is assumed that in the intermediate image, the first polymer particle is present in the first surface side close to the intermediate transfer member, while the second polymer particle is present in the second surface side close to the recording medium. The heating of the intermediate image performed under the conditions satisfying relationships (2) and (3) does not soften the first polymer particle in the first surface side, but does soften the second polymer particle in the second surface side. Thus, the fluidity of the intermediate image is increased in the second surface side and reduced in the first surface side.

Also, the intermediate image is heated so as to satisfy the relationship 1.5<Eb/Ea. Consequently, the portion of the intermediate image near the second surface becomes softer than the portion of the intermediate image near the first surface. Thus, the fluidity of the intermediate image is increased in the second surface side and reduced in the first surface side.

In the present embodiment, the fluidity of the intermediate image is controlled so as to increase in the second surface side and decrease in the first surface side by the synergism of the relationships (1) to (3) and 1.5<Eb/Ea, as described above. Consequently, the efficiency of transfer from the intermediate transfer member to the recording medium in high speed printing can be increased.

The elastic moduli Ea and Eb can be measured by, for example, an indentation method or dynamic viscoelasticity measurement. The indentation method is a method for estimating the elastic modulus of an object by continuously measuring the load and depth of an indenter while the indenter is pushed onto the surface of the object at a constant load. The dynamic viscoelasticity measurement is a method for estimating the magnitude of viscoelasticity of an object by applying a stress with a certain frequency and calculating the elastic modulus or the viscosity using the stress and deformation. These methods enable the measurement of elastic modulus with high repeatability even if the object is very thin like the intermediate image. In either method, the elastic modulus corresponding to storage modulus is advantageously used as the elastic modulus in the present embodiment. In practice, values measured by a method whose correlation and repeatability have been verified may be used.

The term "recording medium" mentioned herein refers to not only paper generally used for printing, but also cloth, plastics, films and other recording media.

The members and materials used in the image recording method of the present embodiment will now be described in detail.

Intermediate Transfer Member

The intermediate transfer member acts as the substrate on which the reaction liquid and the ink are held to form an intermediate image. The intermediate transfer member may include a support member adapted to handle the intermediate transfer member and transmit required power, and a surface member on which images are formed. The support member and the surface member may be defined by a single member in one body, or may be defined by their respective members.

The structure of the intermediate transfer member may be appropriately selected according to the type of the recording medium, the capability thereof to hold images, the efficiency in transferring images to the recording medium, or the quality of the transferred image. The intermediate transfer member may further include another one or more layers, in addition to the support member and the surface member. For example, the intermediate transfer member may be provided with a compression layer to even uneven pressure applied for transfer. The compression layer is made of a porous material containing rubber or elastomer, which may be a known material. Also, intermediate transfer member may be provided with a resin layer, a base cloth, a metal layer, or the like to impart appropriate elasticity, intensity, thermal properties, and so forth. The surface member and the support member may be fixed or held by an adhesive or a double-side adhesive tape disposed therebetween.

The support member may be in the shape of a sheet, a roller, a drum, a belt, or an endless web. The support member in a drum-like shape or a belt-like endless web form enables continuous and repetitive use of one intermediate transfer member. This is very advantageous in terms of productivity. The intermediate transfer member may have any size depending on the size of the image to be printed.

The support member of the intermediate transfer member is required to have a strength to some extent from the viewpoint of conveyance accuracy and durability. Suitable materials of the intermediate transfer member include metals, ceramics and resins. Among these materials, advantageous are aluminum, iron, stainless steel, acetal resin, epoxy resin, polyimide, polyethylene, polyethylene terephthalate, nylon, polyurethane, silica ceramics, and alumina ceramics. These materials are suitable in view of the rigidity of the support member against pressure applied for transfer and the dimensional accuracy, and suitable to reduce the inertia in operation to improve control response. Two or more of these materials may be combined.

Since the surface member of the intermediate transfer member is used for transferring an image to a recording medium such as paper by pressing the image on the recording medium, the surface is desirably elastic to some extent. For example, when paper sheet is used as the recording medium, it is desirable that the surface member be made of a rubber having an elasticity corresponding to a type A durometer hardness (specified in JIS K 6253) in the range of 10° to 100°. A rubber member having a type A durometer hardness in the range of 20° to 60° is more desirable.

Also, the surface member may be made of any material, such as polymer, ceramic, or metal. In an embodiment, a rubber or an elastomer may be used in view of the above-described characteristics and workability. In particular, the use of the surface member made of a water-repellent material having a low surface energy reduces the adhesion energy with the intermediate image to increase the efficiency of image transfer. Suitable materials of the surface member include silicone rubber, fluorocarbon rubber, and compounds containing a skeleton structure of these rubbers. In view of surface energy, a compound containing a water-repellent structure, such as a silicone skeleton or a perfluoroalkyl skeleton may be advantageous. From the viewpoint of reducing the fluidity of the intermediate image on the intermediate transfer member, the surface member may have a desired surface roughness Ra specified in JIS B601 (2001). The average surface roughness Ra may be in, but is not limited to, the range of about 0.01 μm to 3 μm.

Reaction Liquid

The constituents of the reaction liquid will now be described.

(a) Constituent for Increasing the Viscosity

The reaction liquid contains a material that will react with ink to increase the viscosity of the ink (hereinafter referred to as ink viscosity increasing material). "Ink viscosity increasing" mentioned herein implies that the coloring material, resin or any other constituent in the ink comes in contact with the ink viscosity increasing material and reacts with or physically adsorbs to the ink viscosity increasing material to increase the viscosity of the ink as a whole. Also, it also implies that the viscosity of the ink is locally increased by aggregation of part of the constituents, such as the coloring material, in the ink composition.

The use of the ink viscosity increasing material can reduce the fluidity of the ink on the intermediate transfer member, thereby suppressing bleeding and beading caused when images are recorded. The ink viscosity increasing material may be selected from among known materials including polyvalent metal ions, organic acids, cationic polymers, and porous particles without particular limitation. Polyvalent metal ions and organic acids are particularly advantageous. It may also be advantageous to use one or more of these ink viscosity increasing materials in combination. The content of the ink viscosity increasing material in the reaction liquid is desirably in the range of 5% by mass to 90% by mass relative to the total mass of the reaction liquid.

More specifically, metal ions that can be used as the ink viscosity increasing material include divalent metal ions and trivalent metal ions. Examples of divalent metal ions include $Ca^{2+}$, $Cu^{2+}$, $Ni^{2+}$, $Mg^{2+}$, $Sr^{2+}$, $Ba^{2+}$, and $Zn^{2+}$. Examples of trivalent metal ions include $Fe^{3+}$, $Cr^{3+}$, $Y^{3+}$, and $Al^{3+}$.

Examples of organic acids that can be used as the ink viscosity increasing material include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidonecarboxylic acid, pyronecarboxylic acid, pyrrolecarboxylic acid, furancarboxylic acid, pyridinecarboxylic acid, coumalic acid, thiophenecarboxylic acid, nicotinic acid, oxysuccinic acid, and dioxysuccinic acid.

The reaction liquid may contain an appropriate amount of water or organic solvent. The water is desirably deionized by ion-exchange. The organic solvent that may be used in the reaction liquid is not particularly limited, and can be selected from known organic solvents.

(b) First Polymer Particle

The reaction liquid contains a first polymer particle. This enables the quality and fixability of images to increase. The first polymer particle can be selected from among known resins without particular limitation as long as the above-described relationships: (3) $T1<Ta$; and $1.5<Eb/Ea$ can hold true. Exemplary materials of the first polymer particle include polyolefin, polystyrene, polyurethane, polyester, polyether, polyurea, polyamide, polyvinyl alcohol, poly(meta)acrylic acids and their salts, polyalkyl (meta)acrylates, and homopolymers or copolymers of polydiens. The reaction liquid may contain two or more types of first polymer particle.

The first polymer particle softens into a soft state sufficient for transfer from a solid state at temperature T1. The softening of the first polymer particle may also refer to melting. Temperature T1 may be defined by the glass transition temperature (Tg), softening temperature (Ts) or melting temperature (Tm) of the first polymer particle, depending on the material of the first polymer particle and the temperature of transfer. The same applies to the temperature at which the second polymer particle softens. Temperature T1 may be 30° C. or more, and preferably 40° C. or more. If temperature T1 is 30° C. or more, the heat resistance of the final printed article does not decrease, and the intermediate image can be satisfactorily fixed. The upper limit of temperature T1 is not set, and, for example, a polymer particle having temperature T1 of 200° C. or less may be used as the first polymer particle.

The glass transition temperature or melting temperature of the first polymer particle can be measured by differential scanning calorimetry (DSC). For example, the first polymer particle is encapsulated and subjected to temperature changes with a reference material. The melting or glass transition, which is a change by temperature changes, can be examined by measuring the difference in amount of heat between the reference material and the first polymer particle.

The softening temperature of the first polymer particle can be measured by thermomechanical analysis (TMA). For example, a resin sample of the first polymer particle is deformed into a specimen of 5 mm by 20 mm at a temperature more than or equal to the softening temperature thereof. In TMA, the specimen in contact with a probe is subjected to temperature changes while a load is being applied thereto. Deformation such as thermal expansion or softening can be examined. When the softening temperature of the first polymer particle is temperature T1, temperature T1 thus can be measured.

The measurements of the transition temperature Tg, the softening temperature Ts and the melting temperature Tm of the first polymer particle have been described. The transition temperature Tg, the softening temperature Ts and the melting temperature Tm of the second polymer particle can also be measured in the same manner as described above.

The mass average molecular weight of the first polymer particle may be in the range of 1,000 to 2,000,000. The content of the first polymer particle in the reaction liquid may be in the range of 1% by mass to 70% by mass, such as 10% by mass to 60% by mass, and preferably in the range of 15% by mass to 50% by mass. When the content of the first polymer particle is 1% by mass or more, transfer to the recording medium can satisfactorily be performed even if transferring pressure is applied for a short and even if the intermediate image is formed with a high printing duty. When the content of the first polymer particle is 70% by mass or less, the ratio of the ink viscosity increasing material to the first polymer particle in the reaction liquid is not small, and the ink is allowed to form aggregation sufficient for forming a high-quality intermediate image and performing good transfer.

In an embodiment, the reaction liquid may be used in the form of polymer particle dispersion in which first polymer particles are dispersed. The first polymer particles may be dispersed by any process. For example, particles of a homopolymer or copolymer of one or more monomers having a dissociable group are dispersed, and a thus prepared dispersion of self-dispersible polymer particles is advantageously used. Exemplary dissociable groups include carboxy, sulfo and phosphate groups, and monomers having such a dissociable group include acrylic acid and methacrylic acid. Alternatively, a dispersion of emulsifier-dispersed polymer particles may be used which is prepared by dispersing the first polymer particles with an emulsifier. A known surfactant may be used as the emulsifier. A nonionic surfactant or a surfactant having the same charge as the first polymer particle is advantageous as the surfactant.

In the polymer particle dispersion, the first polymer particle may have a particle size in the range of 10 nm to 1000 nm, such as 100 nm to 500 nm. For preparing the polymer particle dispersion, some additives may be added to stabilize the dispersion. Examples of the additives include n-hexadecane, dodecyl methacrylate, stearyl methacrylate, chlorobenzene, dodecyl mercaptan, olive oil, blue dye (Blue 70), and polymethyl methacrylate.

(c) Third Particle

The reaction liquid may further contain a third particle different from the first polymer particle. The thermal conductivity $\lambda 1$ of the first polymer particle and the thermal conductivity $\lambda 3$ of the third particle desirably satisfy the relationship: $\lambda 3<\lambda 1$. Thermal conductivity is an index representing the quantity of heat transmitted through a material when the material has a temperature gradient. Hence, a material having a lower thermal conductivity is less likely to conduct heat. Since the components of the intermediate image derived from the reaction liquid are expected to be present locally in the first surface side (closer to the intermediate transfer member) as described above, the third particle is also present locally in the first surface side. By adding the third particle satisfying the relationship $\lambda 3<\lambda 1$ to the reaction liquid, heat becomes less likely to be transmitted to the portion of the intermediate image close to the intermediate transfer member, and consequently, temperature increase is hindered. Thus, the difference in the temperature of the intermediate image between the first surface and the second surface can be increased. The material of third particle need not be a resin, but is advantageously a resin. Even if the third particle is a polymer particle, the third particle does not satisfy the relationships (2), (3) and $1.5<Eb/Ea$, unlike the first polymer particle.

For the third particle having a low thermal conductivity, hollow particles are advantageous as the third particle. Since air has a low thermal conductivity, the apparent thermal conductivity of the third particle composed of hollow particles can be low. The third particle may be, for example, Hollowed Particles SX series (manufactured by JSR), Matsumoto Microsphere (manufactured by Matsumoto Yushi-Seiyaku), Silica Balloon Nanoparticle (manufactured by Nittetsu Mining), or any other commercially available product.

The thermal conductivity $\lambda 3$ of the third particle may be measured as below. A resin sample of the third particle is deformed into a specimen at a temperature more than or equal to the temperature (glass transition temperature Tg, softening temperature Ts, or melting temperature Tm) at which the sample softens. The specimen is given a steady temperature gradient in the thickness direction by heating one side of the specimen and cooling the other side. The thermal conductivity is estimated from the amount of heat transmitted through the specimen and temperature difference. Alternatively, heat may be unsteadily applied by a pulsed laser beam to the specimen formed of the third particle, and thus the thermal conductivity is estimated from the amount of heat conduction and temperature difference. The thermal conductivity $\lambda 1$ of the first polymer particle can be measured in the same manner as the thermal conductivity $\lambda 3$ of the third particle. Since the thermal conductivity of the above-described hollow particles decreases close to that of air (0.0241 to 0.0317 W/(m·K) at a temperature of 0° C. to 100° C.), the internal structure of the particles can be estimated from the measured value of the thermal conductivity.

(d) Other Constituents

The reaction liquid may further contain a surfactant or a viscosity modifier to control the surface tension or the viscosity, if necessary. Any surfactant or viscosity modifier may be used as long as it can coexist with the ink viscosity increasing material. Examples of the surfactant include Acetylenol E 100 (produced by Kawaken Fine Chemicals), polyester-modified siloxane compounds BYK 347, BYK 348 and BYK 349 (produced by BYK), and a fluorine compound Zonyl FSO 100 (produced by Du Pont).

Ink

The constituents of the ink used in the present embodiment will be described below.

(a) Coloring Material

The ink may contain at least one of pigments and dyes as a coloring material. The coloring material can be selected from among the dyes and pigments generally used in inks without particular limitation, and a desired amount of the selected material can be used. For example, for an ink jet ink, a known dye, carbon black, an organic pigment, or the like may be used as the coloring material. A solution or dispersion of a dye and/or a pigment may be used as the ink. Pigments are suitable as the coloring material. The use of a pigment in the ink advantageously increases the fastness and image quality of printed articles. If a pigment is used, a known inorganic or organic pigment may be used without particular limitation. More specifically, pigments designated by color index (C.I.) numbers can be used. A carbon black may be used as a black pigment. The pigment content in the ink may be 0.5% by mass to 15.0% by mass, such as 1.0% by mass to 10.0% by mass.

(b) Dispersant

The ink may further contain a pigment dispersant for dispersing the pigment. A known pigment dispersant may be used, and a water-soluble dispersant having a molecular structure including both a hydrophilic site and a hydrophobic site is advantageous. A pigment dispersant is particularly advantageous which contains a resin produced by copolymerizing at least a hydrophilic monomer and a hydrophobic monomer. The monomers are not particularly limited, and any known monomers can be used. Examples of the hydrophobic monomer include styrene, styrene derivatives, alkyl (meta)acrylate, and benzyl (meta)acrylate. Examples of the hydrophilic monomer include acrylic acid, methacrylic acid, and maleic acid. The pigment dispersant containing such a resin is a constituent that adsorbs to the surfaces of the pigment to help the pigment disperse stably, and is different from the second polymer particle.

The pigment dispersant may have an acid value in the range of 50 mg KOH/g to 550 mg KOH/g. The mass average molecular weight of the pigment dispersant may be in the range of 1,000 to 50,000. The ratio of the pigment to the pigment dispersant may be in the range of 1:0.1 to 1:3.

In an embodiment, a self-dispersible pigment that has been surface-modified so as to be dispersible may be used instead of using a dispersant in the ink.

(c) Second Polymer Particle

The ink contains a second polymer particle. This enables the quality and fixability of images to increase. The second polymer particle can be selected from among known resins without particular limitation as long as the above-described relationships: (2) $T2<Ta$; and $1.5<Eb/Ea$ can hold true. The second polymer particle may have the same mass average molecular weight and be used in the same form as the first polymer particle, as long as the relationships (2) $T2<Ta$ and $1.5<Eb/Ea$ can hold true.

The second polymer particle softens into a soft state sufficient for transfer from a solid state at temperature T2, and a polymer particle having temperature T2 appropriate for transfer can be selected as the second polymer particle. Temperature T2 may be 30° C. or more, and preferably 40° C. or more. The use of the second polymer particle having temperature T2 of 30° C. or more can increases the fixability of the intermediate image. The upper limit of temperature T2 is not set, and, for example, a polymer particle having temperature T2 of 200° C. or less may be used as the second polymer particle. The softening of the second polymer particle may also refer to melting. Temperature T2 may be defined by the glass transition temperature (Tg), softening temperature (Ts) or melting temperature (Tm) of the second polymer particle, depending on the material of the second polymer particle and the temperature for transfer. The glass transition temperature Tg, softening temperature Ts and melting temperature Tm of the second polymer particle can be measured in the same manner as those of the first polymer particle.

(d) Surfactant

The ink may contain a surfactant. Examples of the surfactant include Acetylenol EH (produced by Kawaken Fine Chemicals), polyester-modified siloxane compounds BYK 347, BYK 348 and BYK 349 (produced by BYK), and a fluorine compound Zonyl FSO 100 (produced by Du Pont). The surfactant content in the ink may be in the range of 0.01% by mass to 5.0% by mass relative to the total mass of the ink.

(e) Water and Water-Soluble Organic Solvent

The ink may also contain water and/or a water-soluble organic solvent as the solvent. The water is desirably deionized by ion-exchange. The water content in the ink may be in the range of 30% by mass to 97% by mass relative to the total mass of the ink. The water-soluble organic solvent is not particularly limited, and may be selected from among known organic solvents. Examples of the water-soluble organic solvent include glycerol, diethylene glycol, polyethylene glycol, and 2-pyrrolidone. The content of the water-soluble organic solvent in the ink may be in the range of 3% by mass to 70% by mass relative to the total mass of the ink.

(f) Other Additives

The ink may further contain other additives, such as a pH adjuster, a rust preventive, a preservative, a fungicide, an antioxidant, an antireductant, a water-soluble resin and its neutralizer, and a viscosity modifier, as needed.

Application of Reaction Liquid

The application of the reaction liquid to the surface of the intermediate transfer member may be performed by a method appropriately selected from among the known methods. For example, the reaction liquid may be applied by die coating, blade coating, use of a gravure roller, use of an offset roller, or spray coating. Alternatively, the reaction liquid may be applied using an ink jet device. Some of these methods may be combined.

Formation of Intermediate Image

Subsequently, the ink containing the second polymer particle is applied to the surface of the intermediate transfer member on which the reaction liquid has been applied, thus forming an intermediate image. The intermediate image mentioned herein refers to the image formed on the intermediate transfer member by bringing the ink into contact with the reaction liquid and then subjected to transfer to a recording medium. Although the ink may be applied by any method, an ink jet method is advantageous. The ink jet device for the ink jet method may be of a type that ejects ink by film-boiling the ink by electrothermal conversion so as to bubble. Alternatively, the ink jet device may be of a type that ejects ink by electromechanical conversion or static electricity. As mentioned above, any ink jet device used for the ink jet liquid ejection technique can be used. From the viewpoint of high-speed, high-density printing, the electrothermal conversion type is advantageous.

The structure of the ink jet device is not particularly limited. For example, the ink jet device may be what is called a shuttle ink jet head that moves for printing in a direction perpendicular to the movement of the intermediate transfer member. Alternatively, the ink jet device may be what is called a line head having ink ejection openings are aligned in a line in a direction substantially perpendicular to the movement of the intermediate transfer member (for a drum-shaped transfer medium, in a direction substantially parallel to the axis direction).

Heating and Transfer of Intermediate Image

The intermediate image formed on the intermediate transfer member is transferred to a recording medium by being heated under the conditions satisfying the following relationships (1) to (4).

In this transferring step, the surface temperature Ta of the recording medium and the surface temperature Tb of the intermediate transfer member are set so as to satisfy the relationships: (1) $Tb<Ta$, (2) $T2<Ta$, and (3) $Tb<T1$. T1 represent the temperature at which the first polymer particle softens and T2 represents the temperature at which the second polymer particle softens.

Also, the heating is performed so that the elastic modulus Ea of the intermediate image at a temperature equal to Ta and the elastic modulus Eb of the intermediate image at a temperature equal to Tb satisfy the relationship (4) $1.5<Eb/Ea$.

The intermediate image is heated under the conditions satisfying the relationships (1) to (4) and the method of this heating is not otherwise limited. For example, the intermediate image may be heated with heaters in the intermediate transfer member and a roller-shaped transfer device (transfer roller). In this instance, the heating conditions satisfying relationships (1) to (4) are controlled by adjusting the contact time between and temperatures of the recording medium and the intermediate image. Alternatively, the intermediate image may be heated by being irradiated with infrared radiation so that a specific substance in the image having adsorbed light generates heat. In this instance, the heating conditions are controlled so as to satisfy relationships (1) to (4) by adjusting the irradiation time, the range of infrared wavelengths, and the irradiation intensity. Although the heating of the intermediate image may be started before transfer, the heating for transferring the intermediate image is performed under the conditions satisfying relationships (1) to (4). For heating by irradiation with infrared radiation, the intermediate image may be irradiated, for example, upstream, in the conveyance direction of the recording medium, from the position at which the image is transferred with the pressure roller of the apparatus shown in FIG. 1.

For transferring the intermediate image from the intermediate transfer member to a recording medium, the pressure roller may be disposed so as to abut on the intermediate transfer member and thus used so that the recording medium passes between the pressure roller and the recording medium. Temperature T1 at which the first polymer particle softens and Temperature T2 at which the second polymer particle softens desirably satisfy the relationship $T1>T2$. In this condition, the first polymer particle is less easy to soften, and the difference in fluidity between the first surface side and the second surface side of the intermediate image is increased.

The specific heat C1 of the first polymer particle and the specific heat C2 of the second polymer particle desirably satisfy the relationship $C1>C2$. The specific heat of a substance is the amount of heat per unit mass required to raise the temperature of the substance by 1° C. The higher the specific heat, the less easy to raise the temperature. As described above, it is assumed that in the intermediate image on the intermediate transfer member, the first polymer particle is present in the first surface, while the second polymer particle is present in the second surface. Accordingly, when the relationship $C1>C2$ holds true, the heating of the intermediate image less easily raises the temperature of the first surface side of the intermediate image, but more easily raises the temperature of the second surface side of the image. Thus, the fluidity of the intermediate image can be increased in the second surface side and reduced in the first surface side.

The specific heats C1 and C2 of the first and second polymer particles can be measured by differential scanning calorimetry (DSC). For example, the first and the second polymer particle are each encapsulated and subjected to temperature changes with a reference material whose specific heat is known. The specific heats of the first and second polymer particles at a constant pressure can be estimated from the thus measured differences in amount of heat between the reference material and the first polymer particle and between the reference material and the second polymer particle.

Surface temperatures Ta and Tb are not particularly limited within the range satisfying the relationships (1) to (3) and $1.5<Eb/Ea$, but is desirably in the range of 25° C. to 200° C. By controlling the surface temperatures in this range, the intermediate image can be satisfactorily transferred and image quality can be prevented from being degraded by excessive heating of the intermediate image. Desirably, surface temperature Ta is 5° C. or more higher than surface temperature Tb. Hence, it is desirable to satisfy $Ta>(Tb+5)$. Preferably, surface temperature Ta is 10° C. or more higher than surface temperature Tb. When surface temperatures Ta and Tb have such a difference, the difference in the fluidity of the intermediate image between the first surface side and the second surface side is increased.

Also, the elastic modulus Ea of the intermediate image at a temperature equal to Ta and the elastic modulus Eb of the intermediate image at a temperature equal to Tb desirably satisfy the relationship $2<Eb/Ea$, preferably $5<Eb/Ea$. In this condition, the difference in fluidity between the first surface side and the second surface side of the intermediate image is increased effectively.

Desirably, temperatures T1 and T2 satisfy at least one of the relationships: 40° C.<T1 and 40° C.<T2 from the viewpoint of increasing the heat resistance of the image transferred to the recording medium. Preferably, temperatures T1 and T2 satisfy at least one of the relationships: 60° C.<T1 and 60° C.<T2.

Removal of Liquid Component

In an embodiment, the liquid component in the intermediate image on the intermediate transfer member may be removed in a step of the process of recording an image. This step of removing the liquid component prevents the excess liquid component in the intermediate image from leaching out or overflowing during transfer and thus prevents image disturbance and transfer failure. For removing the liquid component, any of the known methods may be applied. For example, the liquid composition may be removed by heating the intermediate image, blowing low-humidity air on the intermediate image, reducing pressure, bringing an absorber into contact with the intermediate image, or a combination of these methods. Natural drying may also be applied.

Fixing

The recording medium on which the transferred image has been formed may be pressed with a roller to firmly fix the image to the recording medium. Heating the recording medium may also be effective in increasing the fixability. These fixing techniques may simultaneously be applied using a heating roller.

Cleaning

The process of image recording is completed through the above-described operations. If the intermediate transfer member is continuously and repeatedly used from the viewpoint of productivity, the surface of the intermediate transfer member may be cleaned to restore it before subsequent use. For cleaning the intermediate transfer member, any of the known methods may be applied. For example, the surface of the intermediate transfer member may be cleaned by being showered with a cleaning liquid, being wiped with a wet Molton roller in contact therewith, or being brought into contact with the surface of a cleaning liquid. Alternatively, the surface of the intermediate transfer member may be scraped off, or an energy may be applied to the surface of the intermediate transfer member. These techniques may be combined.

Examples

The image recording method of the present application will now be further described in detail with reference to Examples and Comparative Examples. The method is however not limited to the following Examples. In the following description, "part(s)" and "%" are on a mass basis unless otherwise specified.

The FIGURE shows a schematic view of the image recording apparatus used in the following Examples. The intermediate transfer member shown in the FIGURE includes a rotatable support member 12 in the form of a drum, and a surface member 11 disposed over the periphery thereof. The support member 12 is rotated on an axis 13 in the direction indicated by the arrow, and devices arranged around the intermediate transfer member are operated in synchronization with the rotation. In the Examples, a cylindrical member made of an aluminum alloy was used as the support member 12 of the intermediate transfer member in view of required properties including dimensional accuracy and such a rigidity that it is resistant to the pressure for transfer, and from the viewpoint of reducing the inertia in rotation to improve the response to control. The surface member 11 of the intermediate transfer member was a 0.3 mm thick member of silicone rubber (KE 106, produced by Shin-Etsu Chemical) with a type A durometer hardness of 60 degrees.

For applying the reaction liquid, a roller coating device 14 shown in the FIGURE was used. The reaction liquid was continuously applied to the surface of the intermediate transfer member using the roller coating device. In the following Examples, 1.0 g/m$^2$ of reaction liquid was applied onto the intermediate transfer member. Then, an image recording ink was ejected from the ink jet device 15 to form an intermediate image (mirror-reversed image) on the intermediate transfer member. The ink jet device 15 was of a type that ejects ink on demand, using an electrothermal conversion element. The ink jet device is of a line head type in which ink jet heads are aligned in a direction substantially parallel to the axis 13 of the drum of the intermediate transfer member. In the following Examples, the ink jet device 15 formed 10 mm×10 mm intermediate images with a printing duty of 100% or 200% on the intermediate transfer member.

The liquid content in the intermediate image was reduced with a blower 16. The intermediate transfer member contained a heater 17 so that the intermediate image could be heated from the rear of the intermediate transfer member. The apparatus shown in the FIGURE also includes a pressure roller 19. The pressure roller 19 is used for transferring the intermediate image on the intermediate transfer member to a recording medium 18 by bringing the intermediate image into contact with the recording medium. The pressure roller 19 contains a heater 21. In the apparatus shown in the FIGURE, a pressure is applied for efficient image transfer in such a manner that the intermediate image and the recording medium 18 are pinched between the support member 12 and the pressure roller 19. In the following Examples, for high-speed printing, the temperature of the intermediate transfer member in the transferring step was set to 60° C., and the pressure for transfer was applied for 10 ms (conveying speed: 1 m/s, nip length: 10 mm). As the recording medium, printing paper (Aurora Coat, 127.9 g/m$^2$, manufactured by Nippon Paper Industries) was used. Furthermore, for repeatedly reusing the intermediate transfer member for subsequent image recording, the intermediate transfer member was intermittently cleaned with a cleaning unit 21 after the intermediate image was transferred to the recording medium 18. In the apparatus shown in the FIGURE, the cleaning unit 21 is a Molton roller always wet with ion exchanged water. The Molton roller is configured so that the surface thereof can come intermittently into contact with the surface of the intermediate transfer member.

The reaction liquids and the inks were prepared as below.

Preparation of Reaction Liquids

The following constituents were mixed and sufficiently stirred, and then the mixture was subjected to pressure filtration through a microfilter of 3.0 μm in pore size (produced by Fujifilm Corporation). "Balance" in Table 1 implies that water was added so that the total mass of the reaction liquid reached 100%. Also, "mass ratio" of each constituent shown in Table 1 refers to the proportion of the constituent relative to the total mass (100%) of the reaction liquid.

TABLE 1

| | First polymer particle emulsion | | Third particle | | Ink viscosity increasing material | | neutralizer | | Surfactant | | Water |
|---|---|---|---|---|---|---|---|---|---|---|---|
| | Material | Mass ratio | Material | Mass ratio | Material | Mass ratio | Material | Mass ratio | Material | Mass ratio | Mass ratio |
| Reaction liquid 1 | AQUACER 498 | 18 | — | — | Levulinic acid | 45 | Potassium hydroxide | 10 | FSO-100 | 3 | Balance |
| Reaction liquid 2 | JONCRYL 790 | 19 | — | — | Levulinic acid | 45 | Potassium hydroxide | 10 | FSO-100 | 3 | Balance |
| Reaction liquid 3 | AQUACER 531 | 20 | — | — | Levulinic acid | 45 | Potassium hydroxide | 10 | FSO-100 | 3 | Balance |
| Reaction liquid 4 | AQUACER 531 | 20 | SX 866 (B) | 20 | Levulinic acid | 45 | Potassium hydroxide | 10 | FSO-100 | 3 | Balance |

The materials used in Table 1 are as follows:

AQUACER 498 (produced by BYK): paraffin wax emulsion having a melting temperature (Tm) of 60° C. (Temperature T1)

JONCRYL 790 (produced by BASF): styrene-acrylic copolymer emulsion having a glass transition temperature (Tg) of 90° C. (Temperature T1)

AQUACER 531 (produced by BYK): paraffin wax emulsion having a melting temperature (Tm) of 130° C. (Temperature T1)

SX 866 (B) (produced by JSR): crosslinked styrene-acrylic hollow particles

FSO-100 (produced by Du Pont): perfluoroalkylethylene oxide adduct

Preparation of Black Pigment Dispersion Liquid

First, 10 parts of carbon black (product name: Monarch 1100, produced by Cabot), 15 parts of pigment dispersant aqueous solution (containing styrene-ethyl acrylate-acrylic acid copolymer (acid value: 150, mass average molecular weight: 8,000) with a solid content of 20%) neutralized with potassium hydroxide, and 75 parts of pure water were mixed. Then, the mixture was placed in a batch-type vertical sand mill (manufacture by Aimex), and then 200 parts of zirconia beads of 0.3 mm in diameter were placed in the sand mill. The materials in the mixture were thus dispersed with cooling for 5 hours. The resulting dispersion liquid was centrifuged to remove coarse particles, and thus a black pigment dispersion liquid containing about 10% of pigment was prepared.

Preparation of Inks

Inks having compositions shown in Table 2 were prepared. More specifically, the constituents shown in Table 2 were mixed and sufficiently stirred, and then the mixture was subjected to pressure filtration through a microfilter of 3.0 μm in pore size (produced by Fujifilm Corporation). "Balance" in Table 2 implies that water was added so that the total mass of the ink reached 100%. Also, "mass ratio" of each constituent shown in Table 2 refers to the proportion of the constituent relative to the total mass (100%) of the ink.

TABLE 2

| | Pigment | | Second polymer particle emulsion | | Surfactant | | Solvent | | Water |
|---|---|---|---|---|---|---|---|---|---|
| | Material | Mass ratio | Material | Mass ratio | Material | Mass ratio | Material | Mass ratio | Mass ratio |
| Ink 1 | Black pigment dispersion | 20 | JONCRYL 775 | 25 | Acetylenol E 100 | 1 | Glycerol | 10 | Balance |
| Ink 2 | Black pigment dispersion | 20 | JONCRYL 352D | 25 | Acetylenol E 100 | 1 | Glycerol | 10 | Balance |
| Ink 3 | Black pigment dispersion | 20 | JONCRYL 780 | 23 | Acetylenol E 100 | 1 | Glycerol | 10 | Balance |
| Ink 4 | Black pigment dispersion | 20 | Hytec S-3121 | 45 | Acetylenol E 100 | 1 | Glycerol | 10 | Balance |

The materials used in Table 2 are as follows:

JONCRYL 775 (produced by BASF): styrene-acrylic copolymer emulsion having a glass transition temperature (Tg) of 37° C. (Temperature T2)

JONCRYL 352D (produced by BASF): styrene-acrylic copolymer emulsion having a glass transition temperature (Tg) of 56° C. (Temperature T2)

JONCRYL 780 (produced by BASF): styrene-acrylic copolymer emulsion having a glass transition temperature (Tg) of 92° C. (Temperature T2)

Hytec S-3121 (produced by Toho Chemical Industry): ethylene-acrylic copolymer emulsion having a melting temperature (Tm) 77° C. (Temperature T2).

Acetylenol E 100 (produced by Kawaken Fine Chemicals): ethylene oxide-added acetylene glycol The temperature at which the polymer particle softens (Temperature T1 or Temperature T2), the specific heat and the thermal conductivity of each polymer particle are shown in Table 3.

TABLE 3

| | Temperature at which it is soften [° C.] | Specific heat [J/g · ° C.] | Thermal conductivity [w/m · K] |
|---|---|---|---|
| JONCRYL775 | 37 | 1.39 | — |
| JONCRYL352D | 56 | 1.42 | — |
| AQUACER498 | 60 | 2 | 0.3 |
| Hytec S-3121 | 77 | 1.8 | — |
| JONCRYL790 | 90 | 1.45 | — |

TABLE 3-continued

| | Temperature at which it is soften [° C.] | Specific heat [J/g · ° C.] | Thermal conductivity [w/m · K] |
|---|---|---|---|
| JONCRYL780 | 92 | 1.45 | — |
| AQUACER531 | 130 | 2.3 | 0.5 |
| SX866(B) | — | 1.4 | 0.024 |

Evaluation

As described above, 10 mm×10 mm intermediate images with a printing duty of 100% or 200% were formed on the intermediate transfer member using the image recording apparatus shown in FIG. 1. Then, the intermediate transfer member after the intermediate image had been transferred to the recording medium was observed through an optical microscope. The area of the observed intermediate image remaining on the intermediate transfer member was binarized, and the percentage of the area of the remaining intermediate image was rated according to the criteria below. The percentage of transfer when the entirety of the ink was transferred with no remaining intermediate image was defined as 100%.

The surface temperature Ta of the recording medium was measured with a thermocouple disposed on the surface of the pressure roller 19. In a preexamination, it was confirmed that the surface temperature Ta of the recording medium was substantially the same as the surface temperature of the pressure roller 19. For measuring the surface temperature Tb of the intermediate transfer member, a temperature measuring intermediate transfer member having the same shape and the same dimensions as the intermediate transfer member shown in the FIGURE was also prepared with a thermocouple of about 50 μm in diameter exposed at the surface thereof. Thus the surface temperature of this temperature measuring intermediate transfer member was measured with the thermocouple under the same conditions as in the use of the intermediate transfer member shown in the FIGURE.

The elastic moduli Ea and Be were measured as below. An intermediate image was formed on a glass substrate and heated by controlling surface temperatures Ta and Tb as shown in Table 4, thus preparing a specimen. The measurement was performed by the indentation method (using a Fischer scope HM 500, available from Fischer Instruments). The elastic moduli were estimated from the deformation behavior when loads in the range of 0.01 mN to 0.2 mN were applied and released with a probe. In a preexamination, it was confirmed that this measurement does not give the intermediate image a temperature distribution in the thickness direction and allows the intermediate image to have a desired temperature for measurement.

Transfer performance was rated according to the following criteria:

AAA: Percentage of transfer to the recording medium was 95% or more.

AA: Percentage of transfer to the recording medium was 90% or more and less than 95%.

A: Percentage of transfer to the recording medium was 80% or more and less than 90%.

B: Percentage of transfer to the recording medium was 60% or more and less than 80%.

C: Percentage of transfer to the recording medium was less than 60%.

The results are shown in Table 4.

TABLE 4

| | Ink | | Reaction liquid | | | | Elastic modulus ratio | |
|---|---|---|---|---|---|---|---|---|
| | Type | Temperature T2 [° C.] | Type | Temperature T1 [° C.] | Temperature [° C.] Ta | Tb | Eb/Ea | Transfer |
| Example 1 | 3 | 92 | 2 | 90 | 94 | 88 | 1.6 | A |
| Example 2 | 1 | 37 | 1 | 60 | 50 | 46 | 6 | AA |
| Example 3 | 2 | 56 | 1 | 60 | 65 | 55 | 3 | A |
| Example 4 | 1 | 37 | 3 | 130 | 52 | 43 | 10 | AA |
| Example 5 | 2 | 56 | 3 | 130 | 82 | 76 | 30 | AAA |
| Example 6 | 3 | 92 | 3 | 130 | 110 | 99 | 4 | A |
| Example 7 | 2 | 56 | 4 | 130 | 91 | 76 | 90 | AAA |
| Example 8 | 4 | 77 | 3 | 130 | 95 | 90 | 70 | AAA |
| Example 9 | 4 | 77 | 2 | 90 | 85 | 80 | 5 | A |
| Comparative Example 1 | 2 | 56 | 1 | 60 | 25 | 25 | 1.1 | B |
| Comparative Example 2 | 3 | 92 | 1 | 60 | 65 | 75 | 0.1 | C |
| Comparative Example 3 | 3 | 92 | 2 | 90 | 70 | 92 | 0.9 | C |
| Comparative Example 4 | 3 | 92 | 1 | 60 | 80 | 70 | 1.1 | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-082682, filed Apr. 14, 2014, which is hereby incorporated by reference herein in its entirety.

What is claimed is:

1. An image recording method comprising:

applying a reaction liquid containing a first polymer particle onto an intermediate transfer member;

forming an intermediate image by applying an ink containing a second polymer particle onto the intermediate transfer member to which the reaction liquid has been applied; and transferring the intermediate image to a recording medium while heating the intermediate image;

wherein the first polymer particle softens at temperature T1 and the second polymer particle softens at temperature T2, and wherein the transferring is performed so that the surface temperature Ta of the recording medium and the surface temperature Tb of the intermediate transfer member satisfy the relationships: (1) Tb<Ta, (2) T2<Ta, and (3) Tb<T1, and wherein the elastic modulus Ea of the intermediate image at the temperature Ta and the elastic modulus Eb of the intermediate image at the temperature Tb satisfy the relationship 1.5<Eb/Ea.

2. The image recording method according to claim 1, wherein the temperature T1 and the temperature T2 satisfy the relationship T1>T2.

3. The image recording method according to claim 1, wherein the first polymer particle has a specific heat higher than the specific heat of the second polymer particle.

4. The image recording method according to claim 1, wherein the reaction liquid further contains a third particle different from the first polymer particle and having a higher thermal conductivity than the first polymer particle.

5. The image recording method according to claim 4, wherein the third particle has a hollow structure.

6. The image recording method according to claim 1, wherein the surface temperature Ta and the surface temperature Tb satisfy the relationship Ta>(Tb+5).

7. The image recording method according to claim 1, wherein the temperature T1 is 30° C. or more.

8. The image recording method according to claim 1, wherein the temperature T2 is 30° C. or more.

* * * * *